United States Patent [19]

Farrell et al.

[11] 4,361,812

[45] Nov. 30, 1982

[54] VOLTAGE STABILIZED PARTICLE ACCELERATOR SYSTEM AND METHOD

[75] Inventors: Joseph P. Farrell, East Setauket; Chester C. Thompson, Jr., Roslyn Heights, both of N.Y.

[73] Assignee: Radiation Dynamics, Inc., Melville, N.Y.

[21] Appl. No.: 933,562

[22] Filed: Dec. 4, 1978

[51] Int. Cl.[3] ..... H05H 5/06; H05H 9/00

[52] U.S. Cl. ..... 328/233; 313/360.1

[58] Field of Search ..... 328/233, 227, 228, 267; 313/360.1

[56] References Cited

U.S. PATENT DOCUMENTS 3,519,942 7/1970 Mobley ..... 328/233
3,691,377 9/1972 Matsui et al. ..... 328/233 X
3,731,211 5/1973 Purser ..... 328/233
3,793,550 2/1974 Thompson, Jr. ..... 328/233 X

*Primary Examiner*—Palmer C. Demeo
*Attorney, Agent, or Firm*—Howard L. Rose

[57] ABSTRACT

The voltage at the high voltage terminal of a first particle accelerator is stabilized particularly during pulsed operation by producing a compensating current at its accelerator terminal such as to maintain the voltage of the terminal constant. The compensating current is produced by a second particle accelerator coupled between the accelerator terminal and a high voltage terminal connected with a high voltage DC power supply. The charged particle flow through the second particle accelerator is such that the charge on the accelerator terminal of the first accelerator remains substantially constant even though the voltage at the high voltage terminal drops during simultaneous pulsed operation of both particle accelerators.

11 Claims, 1 Drawing Figure

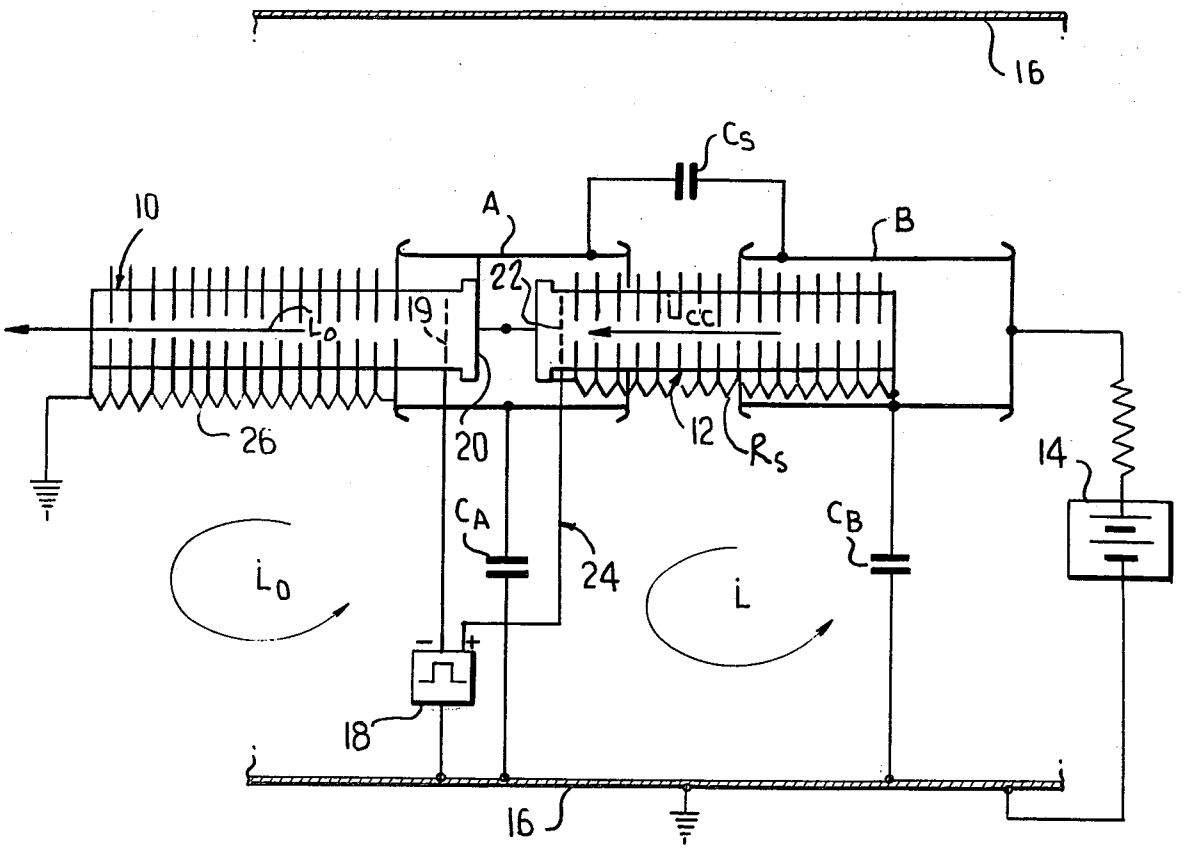
16
14
B
$C_B$
$C_S$
$R_S$
12
$i_L$
$i_{CC}$
24
22
A
20
$C_A$
16
19
18
$L_0$
$i_{L_0}$
26
10

VOLTAGE STABILIZED PARTICLE ACCELERATOR SYSTEM AND METHOD

BACKGROUND OF THE INVENTION

1. Field of the Invention

The present invention pertains to particle accelerators and, more particularly, to a method and system for stabilizing the voltage at a terminal of a particle accelerator primarily during pulsed operation.

2. Discussion

When a high current, short duration pulse is produced from a particle accerator, the terminal voltage will drop to an extent sufficient to reduce undesirably the beam energy. For example, if a high current (5 amp), short duration (20 u sec.) pulse is produced from a high voltage (2 MeV) particle accelerator, the charge, $\Delta q$, is determined by the current, i, times the duration of the pulse, $\Delta t$, and is drawn directly from the high voltage terminal of the DC power supply of the particle accelerator. The power supply terminal voltage will accordingly drop by an amount, $\Delta V = \Delta q/C_T = i\Delta t/C_T$ where $C_T$ is the terminal capacitance. The terminal capacitance, $C_T$, is typically on the order of 100 to 200 pf, and the terminal voltage drop $\Delta V$ will, thus, be 1000 KV for a $C_T$ of 100 pf and 500 KV for a $C_T$ of 200 pf. Consequently, the beam energy during the pulse will decrease by 50% and 25%, respectively, for these cases.

The beam energy change can be reduced by increasing the terminal capacitance; however, the size of the terminal required to increase capacitance sufficiently to materially reduce the voltage drop is prohibitive. For example, if the energy change, $\Delta E$, permissible during a beam pulse is 10 KeV, the terminal capacitance would be determined as $C_T = \Delta q/\Delta V = 100 \times 10^{-6} C/10^4 V = 10^4$ pf; and a terminal of this capacitance would have to be approximately sixty feet in length; it being also a function of diameter and spacing. Additionally, the energy, W, stored on such a terminal is $W = \frac{1}{2} C_T V^2 = 20{,}000$ joules; a quite destructive stored energy level.

SUMMARY OF THE INVENTION

Accordingly, it is a primary object of the present invention to overcome the above-mentioned disadvantges of the prior art by providing a method and system for stabilizing the voltage of a particle accelerator without significantly increasing stored energy.

Another object of the present invention is to obtain high current pulses of very high energy resolution from a constant gradient particle accelerator by providing a compensating current between the high voltage accelerator terminal and the high voltage terminal of a high voltage DC power supply.

A further object of the present invention is to regulate the voltage on a particle accelerator terminal supplied from an unregulated, unfiltered high voltage power supply by supplying a compensating current between the accelerator terminal and a high voltage terminal connected with the power supply.

The present invention has another object in that the voltage on a terminal of a particle accelerator is stabilized by utilizing a compensating current to transfer a charge of the proper polarity between the accelerator terminal and a high voltage terminal connected with a high voltage power supply.

An additional object of the present invention is to transfer charge between a terminal of a high voltage power supply and a terminal of a particle accelerator by means of a second particle accelerator whereby to maintain substantially constant the voltage at the aforesaid accelerator terminal.

Yet a further object of the present invention is to simultaneously pulse first and second particle accelerators such that a beam of charged particles of high energy resolution can be produced by the first particle accelerator while the second particle accelerator transfers a charge between the high voltage terminal of the first particle accelerator and the high voltage terminal of the system power supply to stabilize the voltage at the accelerator terminal.

Some of the advantages of the present invention over the prior art are that the method and system for voltage stabilization can be used with both positive and negative output high voltage power supplies and negative and positive particle accelerators, the method and system can be used to regulate accelerator terminal voltage during both pulsed and steady state operation of a constant gradient particle accelerator, wherein for steady state operation the high voltage power supply can be unregulated and unfiltered, and, for pulsed operation, the system requires very little stored energy. The high voltage power supply need only supply the average power required regardless of the pulse power and a net gain in regulation is obtained by proper choice of circuit parameters. Further, such a voltage stabilized particle accelerator system and method have a distinct advantage in that all of the circuit elements may be located in the high voltage terminals such that the accelerator terminal voltage can be regulated internally by means of sensing circuits located in the high voltage terminal.

The present invention is generally characterized by a voltage stabilized particle accelerator for producing a beam of charged particles, an accelerator terminal electrically coupled with the particle accelerator, a high voltage terminal resistively and capacitively coupled with the accelerator terminal, a high voltage power supply connected with the high voltage terminal, and a compensating current circuit electrically coupled between the accelerator terminal and the high voltage terminal and operable to transfer a charge to or from the accelerator terminal, depending upon the polarity of the particles effecting charge transfer, whereby the voltage at the accelerator terminal is stabilized.

The present invention is further generally characterized in a method of stabilizing the voltage at a terminal of a particle accelerator comprising the steps of supplying a high voltage from a DC power supply to the accelerator terminal of the accelerator via a high voltage terminal, and supplying a compensating current between the terminals whereby stabilization is achieved.

BRIEF DESCRIPTION OF THE DRAWING

The FIGURE is a partial electrical schematic and structural diagram of a voltage stabilized particle accelerator system according to the present invention.

DESCRIPTION OF THE PREFERRED EMBODIMENT

A voltage stabilized particle accelerator system according to the present invention is illustrated in the FIGURE and includes a first particle accelerator 10, such as a constant gradient positive ion accelerator, electrically coupled with a high voltage accelerator terminal A and a second particle accelerator 12, such as an electron accelerator, also electrically coupled with accelerator terminal A. A high voltage DC power supply 14 has a negative terminal connected with ground or other reference potential and a positive terminal connected with a high voltage terminal B electrically coupled with electron accelerator 12. The particle accelerators 10 and 12 and the high voltage terminals A and B are disposed in a grounded pressurized casing 16 as is normal.

Control circuitry 18 is connected to grid 19 of an ion source 20 for ion accelerator 10 and grid 22 of electron accelerator 12 in order to simultaneously pulse the accelerators. A positive pulse is applied to grid 22 and a negative pulse to grid 19.

The structures of the ion and electron accelerators are conventional and are, accordingly, not described in detail; and, similarly, the control circuitry 18 is the same as that conventionally employed to pulse particle accelerators but in the illustrated embodiment modified to pulse two particle accelerators of different polarities.

Included in the drawing are the parameters which must be considered in examining operation of the accelerator circuitry including $R_s$ and $C_s$, the resistance and stray shunt capacitance coupling terminals A and B; $C_A$, the stray capacitance between terminal A and the casing; and $C_B$, the stray capacitance between terminal B and ground. For steady state operation the voltage $V_B$ applied to terminal B from the high voltage power supply 14 can be unregulated and unfiltered since the voltage $V_A$ is regulated by means of the compensating current provided between terminals A and B such that the net change in charge flow from terminal A is nullified by the electron beam current in accordance with the present invention.

For pulsed operation the supply 14 should be stabilized during the interpulse period. Quiescent conditions are established in the circuit as a result of flow of current, I from the source 14 through its internal impedance $Z_o$ thereby establishing the voltage at the source terminal or terminal B, and thence through resistor $R_s$ and the voltage divider resistor string 26 (See U.S. Pat. No. 3,793,550) associated with the beam tube 10. Resistor $R_s$ may be the resistor string or column associated with beam tube 12.

The flow of current I, establishes the quiescent voltage at each location of the system and serves to charge each of capacitors $C_A$, $C_B$ and $C_S$; the above occurring in the absence of beam current in both accelerators. The quiescent conditions are modified of course upon flow of beam current either in the continuous or pulsed mode of operation.

In order to sustain an ion beam pulse of very high current (5 amperes) and constant energy from accelerator 10, it is important to stabilize the voltage at terminal A during the pulse; and, in accordance with the present invention, the voltage at terminal A is stabilized by the bootstrap effect from concurrent pulsed operation of the electron accelerator 12 to provide a compensating current, icc, to terminal A related to the ion beam current, io.

The relationship between the compensating current and the energy regulated pulse current is determined by analyzing the accelerator circuit during a pulse interval. Accordingly, the transient response of terminals A and B during pulsed operation is examined in the following equations:

$$V_A(t)+(1/C_A)\int(i_o-i)dt=0,$$

$$C_B^{-1}\int idt+C_s^{-1}\int(i-i_{cc})dt+C_A^{-1}\int(i-i_o)dt=0,$$

$$V_B(t)-VA\ (t)+C_s^{-1}\int(i_{cc}-i)dt=0,$$

where $i_{cc}$ is the compensating current, $i_o$ is the ion current and i is the displacement current through capacitance $C_B$.

Taking the time derivative of the above equations provides:

$$\frac{1}{C_A}i_o-\frac{1}{C_A}i=-\dot{V}_A(t),$$

$$-\frac{1}{C_A}i_o+\left(\frac{1}{C_B}+\frac{1}{C_s}+\frac{1}{C_A}\right)i-\frac{1}{C_s}i_{cc}=0$$

$$-\frac{1}{C_s}i+\frac{1}{C_s}i_{cc}=-\dot{V}_B(t)+\dot{V}_A(t).$$

Solving these three equations for the currents provides, $$i=-C_B\dot{V}_B(t),$$

$$i_o=-C_A\dot{V}_A(t)-C_B\dot{V}_B(t),$$

$$i_{cc}=C_s\dot{V}_A(t)-(C_s+C_B)\dot{V}_B(t).$$

In accordance with the present invention, it is required that $$\dot{V}_A(t)=0.$$

Therefore:

$$i=-C_B\dot{V}_B(t),$$

$$i_o=-C_B\dot{V}_B(t)\rightarrow\dot{V}_B(t)=-i_o/C_B, \quad (1)$$

$$i_{cc}=(1+C_s/C_B)i_o. \quad (2)$$

Thus, the compensating (electron) current is larger than the (ion) current $i_o$ by a constant factor (1+Cs/CB). This is because it must supply the displacement current caused by the drop in voltage of terminal B as well as the charge required to cancel the voltage drop of terminal A due to the current, $i_o$.

In order for the current $i_{cc}$ to exist between terminals A and B, terminal B must be maintained at a higher potential than terminal A and so:

$$\Delta V_B<V_B^{max}-V_A. \quad (3)$$

where $V_B^{max}$ is the maximum (ambient) voltage of terminal B and, $$\Delta V_B=i_o\Delta t/C_B, \quad (4)$$

is the voltage drop of terminal B during the pulse interval, Δt. For example, if $i_o$=5 amp, Δ=20 μsec, $V_A$=2 MV and choosing $V_B^{max}$=2.5 MV and $\Delta V_B$=0.4 MV, Eq (3) is satisfied, and solving Eq (4) for $C_B$ gives $C_B$=250 pf for the capacitance of terminal B. This is a very modest value of capacitance and is typical of conventional accelerator design.

If the transient current equations are solved for the rate of change of the voltage on terminal A, the equations are:

$$i_o = -C_A\dot{V}_A(t) - C_B\dot{V}_B(t), \quad (5)$$

$$i_{cc} = C_s\dot{V}_A(t) - (C_s + C_B)\dot{V}_B(t). \quad (6)$$

Eliminating the $V_B$ from these two equations and solving for $V_A$ gives:

$$\dot{V}_A = C_B(\Delta i)/(C_AC_B + C_BC_s + C_sC_A) \quad (7)$$

where:

$$\Delta i = i_{cc} - (1 + C_s/C_B)i_o \quad (8)$$

The problem of regulating the voltage, $V_A$, on the accelerator terminal A reduces to a problem of regulating the current $i_{cc}$ between the accelerator terminal and the high voltage terminal. Equation (7) can be used to establish a relation between the voltage regulation at terminal A and the regulation required of the compensating current $i_{cc}$. Solving equation (7) for $\Delta i$ and using equation (2) gives, $$\frac{\Delta i}{i_{cc}} = \left(\frac{C_AC_B + C_BC_s + C_sC_A}{C_B + C_s}\right)\left(\frac{V_A}{i_o\Delta t}\right)\left(\frac{\Delta V_A}{V_A}\right) = \left(C_A + \frac{C_BC_s}{C_B + C_s}\right)\left(\frac{V_A}{i_o\Delta t}\right)\left(\frac{\Delta V_A}{V_A}\right). \quad (9)$$

By eliminating the term, $C_BC_s/(C_B+C_s)$, it follows that, $$\frac{\Delta i}{i_{cc}} > \left(\frac{C_AV_A}{i_o\Delta t}\right)\left(\frac{\Delta V_A}{V_A}\right). \quad (10)$$

This shows that if $C_A$ is chosen such that, $(C_AV_A/i_o\Delta t) > 1$, the regulation required of the current $i_{cc}$ is less than the required voltage regulation; that is, a net gain in regulation is obtained and regulation is readily achievable.

The control required may be accomplished by nothing more than choosing the proper pulse voltages on grids 19 and 22. The currents $i_{cc}$ and $i_o$ are related by Equation (2) and the choice of the current $i_o$ and measurement of paramaters $C_s$ and $C_B$ determines $i_{cc}$. By conventional design techniques the grid voltages necessary to produce such currents at the accelerator voltages employed can be determined. Self regulation may then be relied upon to stabilize the voltage, i.e. as the voltage between terminals A & B varies the electron current varies as a function of the ion current to maintain terminal A at a relatively constant voltage.

If better regulation than is obtainable by self regulation is desired then standard voltage regulation techniques may be employed to superpose a variable voltage on the voltage to grid 22. Sensing of voltage of terminal A relative to ground or of the beam current $i_o$ may be employed to vary a voltage source in grid voltage bias lead 24. In addition, remote control of pulse voltages to grids 19 and 22 may be provided if desired.

The method of voltage control according to the present invention can be applied to both negative and positive terminal accelerators. In the case of a positive terminal accelerator, the pulse current $i_o$ is produced by a beam of positive ions and the compensating current, $i_{cc}$, is produced either by a negative particle source located in the accelerator terminal and causing negatively charged particles to flow from A to B or by another positive ion source located at the high voltage terminal B and causing positive ions to flow from B to A. On the other hand, if the terminal voltage is negative, $i_o$ can be produced by a beam of negative ions or electrons, and $i_{cc}$ can be produced either by an electron source located at the high voltage terminal B or by a positive ion source located in the accelerator terminal A. The relative positioning of the compensating current source is, thus, important due to its influence on the accelerator terminal A.

From the above, it will be appreciated that the method and system of the present invention can be used to stabilize the voltage at the high voltage terminal of a particle accelerator regardless of whether the voltage is positive or negative in that, in accordance with the present invention, an opposite or like polarity charge relative to the charge of the particles being accelerated is transferred from or to, respectively, the accelerator terminal by a compensating current produced by another particle accelerator located between the accelerator terminal and the high voltage terminal.

Inasmuch as the present invention is subject to many variations, modifications and changes in detail, it is intended that the subject matter discussed above or shown in the accompanying drawing be interpreted as illustrative and not in a limiting sense.

What is claimed is:

1. A voltage stabilized particle accelerator system comprising a particle accelerator for producing a beam of charged particles;

an accelerator terminal electrically coupled with said particle accelerator;

a high voltage terminal electrically coupled with said accelerator terminal;

a high voltage power supply connected with said high voltage terminal; and compensating current means electrically coupled with said accelerator terminal and said high voltage terminal and operable to transfer a charge relative to said accelerator terminal such that the voltage at said accelerator terminal is stabilized.

2. A voltage stabilized particle accelerator system as recited in claim 1 wherein said charge transfer means includes a second particle accelerator disposed between said terminals.

3. A voltage stabilized particle accelerator system as recited in claim 2 and further comprising means for simultaneously effecting pulsed charged particle flow in both said first mentioned particle accelerator and said second particle accelerator.

4. A voltage stabilized particle accelerator system as recited in claim 3 wherein said first mentioned particle accelerator is a positive ion accelerator having an ion source coupled with said accelerator terminal and said second particle accelerator is an electron accelerator having an electron source coupled with said accelerator terminal.

5. A voltage stabilized particle accelerator system as recited in claim 3 wherein said first mentioned particle accelerator is a positive ion accelerator having an ion-source coupled with said accelerator terminal and said second particle accelerator is a negative ion accelerator having an ion source coupled with said accelerator terminal.

6. A voltage stabilized particle accelerator system as recited in claim 3 wherein said first mentioned particle accelerator is a positive ion accelerator having an ion source coupled with said accelerator terminal and said second particle accelerator is a positive ion accelerator having an ion source coupled with said high voltage terminal.

7. A voltage stabilized particle accelerator system as recited in claim 3 wherein said first mentioned particle accelerator has a source of negative particles coupled with said accelerator terminal and said second particle accelerator is a positive ion accelerator having an ion source coupled with said accelerator terminal.

8. A voltage stabilized particle accelerator system as recited in claim 3 wherein said first mentioned particle accelerator has a source of negative particles coupled with said accelerator terminal and said second particle accelerator has a source of negative particles coupled with said high voltage terminal.

9. A method of stabilizing the high voltage at a terminal of a first particle accelerator comprising the steps of supplying a high voltage from a power supply to the high voltage terminal of the accelerator via another high voltage terminal; and supplying a compensating current to the accelerator terminal from a second particle accelerator, the compensating current supplying a charge to the accelerator terminal at a rate and of a polarity to compensate for the loss of charge due to flow of charged particles in the first particle accelerator.

10. The method as recited in claim 8 and further comprising the step of operating the first particle accelerator in a steady state mode of operation.

11. The method as recited in claim 8 and further comprising the step of simultaneously pulsing the first and second particle accelerators.

* * * * *